US008192186B2

(12) United States Patent
Moens

(10) Patent No.: US 8,192,186 B2
(45) Date of Patent: Jun. 5, 2012

(54) ROTOR HAVING A COOLING CHANNEL AND COMPRESSOR ELEMENT PROVIDED WITH SUCH ROTOR

(75) Inventor: Erik Eric Daniel Moens, Maldegem (BE)

(73) Assignee: Atlas Copco Airpower, Naamloze Vennootschap, Wilrijk (BE)

( * ) Notice: Subject to any disclaimer, the term of this patent is extended or adjusted under 35 U.S.C. 154(b) by 362 days.

(21) Appl. No.: 12/515,893

(22) PCT Filed: Nov. 8, 2007

(86) PCT No.: PCT/BE2007/000117

§ 371 (c)(1),
(2), (4) Date: May 21, 2009

(87) PCT Pub. No.: WO2008/061325

PCT Pub. Date: May 29, 2008

(65) Prior Publication Data

US 2010/0054980 A1 Mar. 4, 2010

(30) Foreign Application Priority Data

Nov. 23, 2006 (BE) ..... 2006/0569

(51) Int. Cl.
*F04C 27/02* (2006.01)
*F04C 29/02* (2006.01)

(52) U.S. Cl. ..... 418/94; 418/102; 418/201.1

(58) Field of Classification Search ..... 418/94, 418/101, 102, 201.1, 206.3, 206.8
See application file for complete search history.

(56) References Cited

U.S. PATENT DOCUMENTS

| | | | | |
|---|---|---|---|---|
| 5,842,843 | A | 12/1998 | Haga | |
| 5,904,473 | A * | 5/1999 | Dahmlos et al. | 418/206.1 |
| 2005/0069446 | A1 * | 3/2005 | Kriehn | 418/201.1 |
| 2007/0098585 | A1 * | 5/2007 | Yamamoto et al. | 418/201.1 |

FOREIGN PATENT DOCUMENTS

| | | | | |
|---|---|---|---|---|
| EP | 0 777 053 | A1 | | 6/1997 |
| FR | 2 084 314 | A | | 3/1971 |
| GB | 580 064 | A | | 8/1946 |
| GB | 962 277 | A | | 7/1964 |
| JP | 58 059394 | A | | 4/1983 |
| JP | 59115492 | A | * | 7/1984 |
| JP | 61272488 | A | * | 12/1986 |
| JP | 12 37388 | A | | 9/1989 |
| JP | 01237388 | A | * | 9/1989 |
| JP | 10 341556 | A | | 12/1998 |
| JP | 11 182467 | A | | 7/1999 |
| JP | 2004 324468 | A | | 11/2004 |
| SE | 517 211 | C2 | | 5/2002 |
| SU | 918 528 | A1 | | 4/1982 |

OTHER PUBLICATIONS

Examination Report of China Patent Office regarding CN 200780043315.2, Sep. 3, 2011.

* cited by examiner

*Primary Examiner* — Theresa Trieu
(74) *Attorney, Agent, or Firm* — Bacon & Thomas, PLLC

(57) ABSTRACT

Rotor having a shaft having an axial direction, where an inner and central cooling channel with an inlet and an outlet for a cooling agent is provided in this shaft, extending in the above-mentioned axial direction. Additionally, the above-mentioned cooling channel is at least partly provided with inwardly directed fins.

22 Claims, 5 Drawing Sheets

ROTOR HAVING A COOLING CHANNEL AND COMPRESSOR ELEMENT PROVIDED WITH SUCH ROTOR

FIELD OF THE INVENTION

The present invention concerns a rotor, in particular a rotor that is applied for example in different types of compressors, generators, motors and the like.

BACKGROUND

Rotors of screw compressors are already known from JP 2004324468 and JP 1237388, whereby these rotors are provided with a shaft in which is provided an inner, central and axially directed cooling channel where cooling oil is sent through so as to improve the efficiency of the compressor.

Such known rotors do no allow for a proper, efficient conditioning of the rotor geometry over a wide operational range, however.

From SE 517.211 is already known a rotor in which is provided a cooling channel with a turbulence amplifying element in it, made of polymer in the shape of a spiral element.

In practice, it turns out that such a turbulence amplifying element does not provide the hoped-for result either of a proper, efficient conditioning as far as heat transfer is concerned; moreover, especially with liquids, there will be additional pressure drops.

SUMMARY

The present invention aims a rotor that allows for a very efficient geometric conditioning.

To this end, the present invention concerns a rotor comprising an axially directed shaft, whereby an inner and central cooling channel with an inlet and an outlet for a cooling medium is provided in this shaft, extending in the above-mentioned axial direction, whereby the above-mentioned cooling channel is at least partly provided with inwardly directed fins.

Simulations have revealed that the application of inwardly directed fins provides for a more efficient heat transfer between the cooling agent and the rotor.

For, by providing such inwardly directed fins, not only the turbulence in the cooling agent increases, but also a considerable increase of the heat-exchanging surface is obtained.

Moreover, there is a phenomenon whereby there is not only obtained a spiral flow from the cooling agent centrally in the cooling channel, which is for example the case in the above-mentioned document SE 517.211, but whereby a secondary flow is obtained between the adjacent fins which considerably promotes the heat transfer between the rotor and the cooling agent.

It should also be noted that the application of inwardly directed fins is not an obvious choice, since one would at first instance expect such rotating fins to have a rather negative effect on the flow resistance on the incoming cooling agent.

According to a preferred characteristic of the invention, the above-mentioned fins have a spiral pattern in the axial direction of the rotor.

For it appears that such a spiral pattern has a very positive effect on the flow pattern of the cooling agent in the cooling channel, as a result of which an even better heat transfer is obtained.

In the above-mentioned cooling channel, near the above-mentioned inlet for a cooling agent, are preferably provided means that provide the cooling agent, near a rotating rotor, with a tangential component of velocity.

The presence of the above-mentioned means makes sure that flow losses can be largely restricted, as the cooling agent that enters the cooling channel gets a tangential component of velocity, as a result of which a good inflow between the inwardly directed fins is made possible.

Moreover, the presence of such means which provide for a tangential component of velocity makes sure that the favourable flow pattern of the cooling agent will certainly extend over the entire length of the fins.

The present invention is very appropriate for the application of rotors in devices whereby heat must be discharged, such as compressors, generators, motors and the like.

In the case of screw compressors, this is extremely important since, in this type of compressors, the air is compressed between the helical rotors turning with their lobes into one another, whereby the play between both rotors should be as small as possible for an efficient compression and, as a consequence, it is very important to restrict the expansion of the rotors in view of an efficient cooling.

The present invention also concerns a compressor element that is provided with a housing having a compression chamber, in which provided at least one rotor as described above in a rotating manner.

BRIEF DESCRIPTION OF THE DRAWINGS

In order to better explain the characteristics of the present invention, the following preferred embodiment of a rotor according to the invention is described as an example only without being limitative in any way, as well as a compressor element that is provided with such a rotor, with reference to the accompanying drawings, in which.

DETAILED DESCRIPTION OF EXEMPLARY EMBODIMENTS OF THE DISCLOSURE

Figure 1:
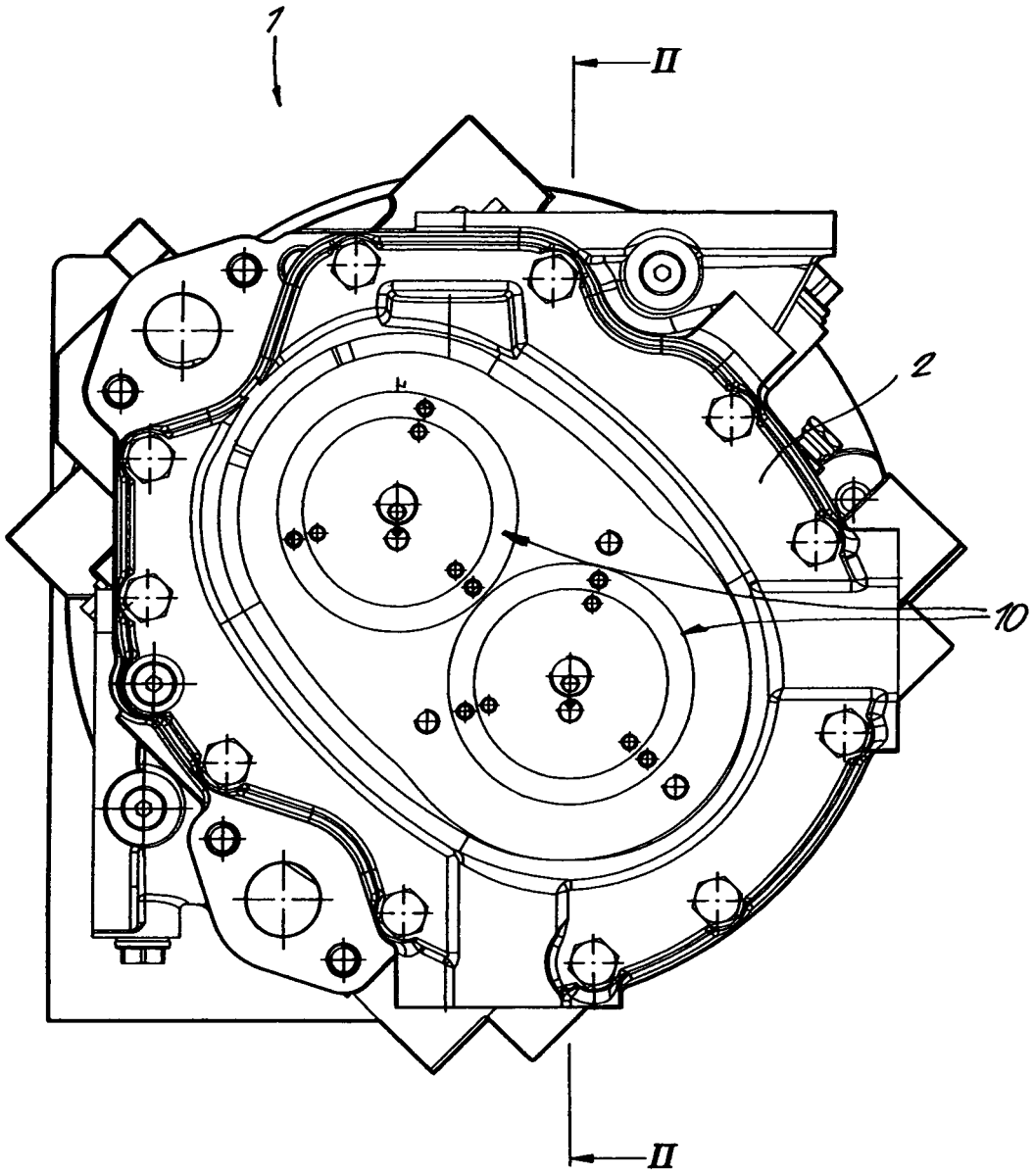
FIG. 1 schematically represents a side view of a compressor element that is provided with two rotors according to the invention.
Figure 2:
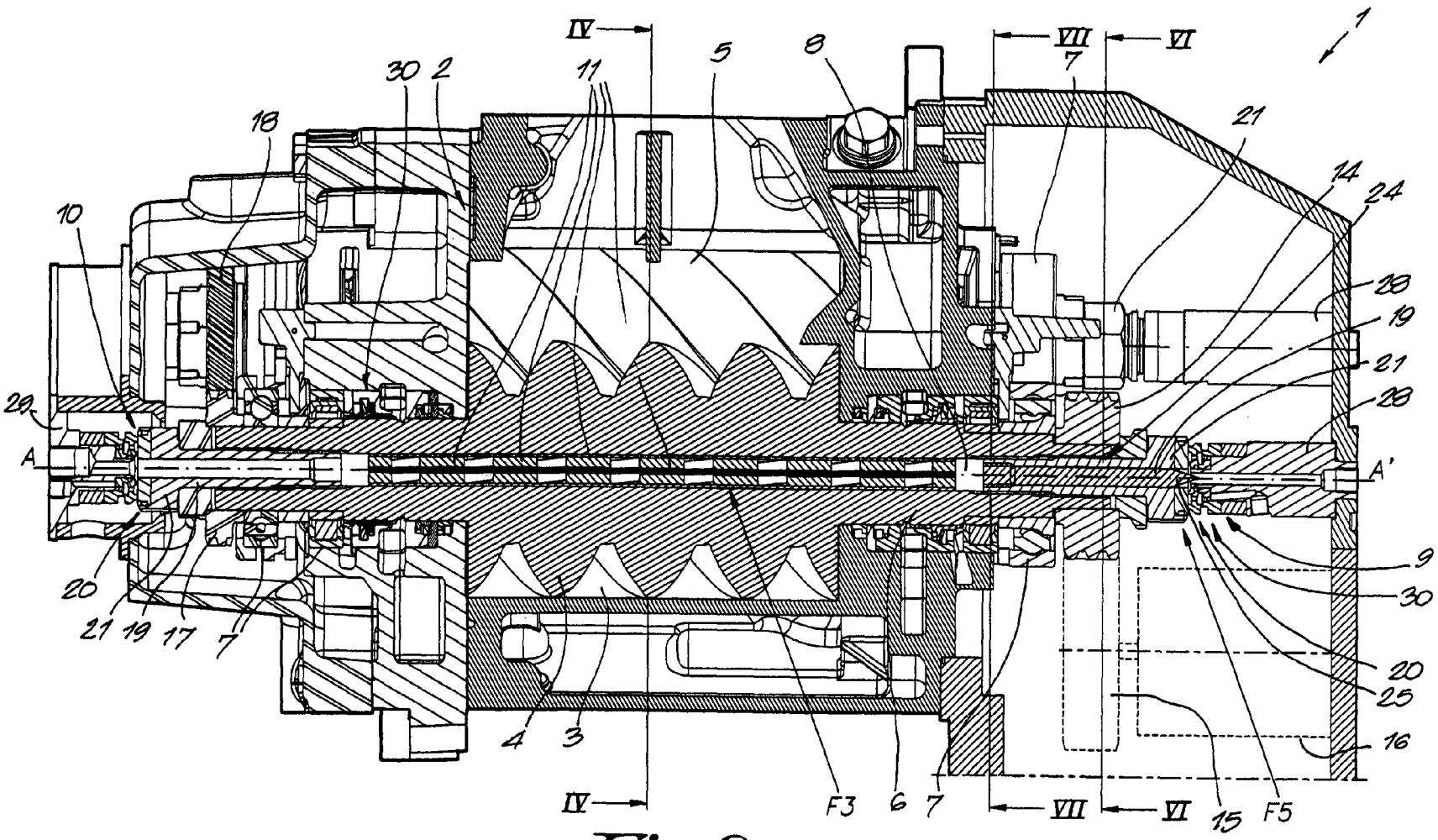
FIG. 2 is a section according to line II-II in FIG. 1.

FIGS. 1 and 2 represent a compressor element 1 which is in this case made in the form of a screw compressor element comprising a housing 2 with a compression chamber 3 and two meshing rotors in it, a male rotor 4 and a female rotor 5 respectively which each comprise a shaft 6 whose far ends are provided in a rotating manner in the housing 2 by means of bearings 7.

In this case, both rotors 4 and 5 are provided with an inner cooling channel 8, with an inlet 9 and an outlet 10 for a cooling agent, extending centrally in the shaft 6 in the axial direction A-A' of the respective shaft 6 in which the cooling channel 8 extends.

Figure 3:
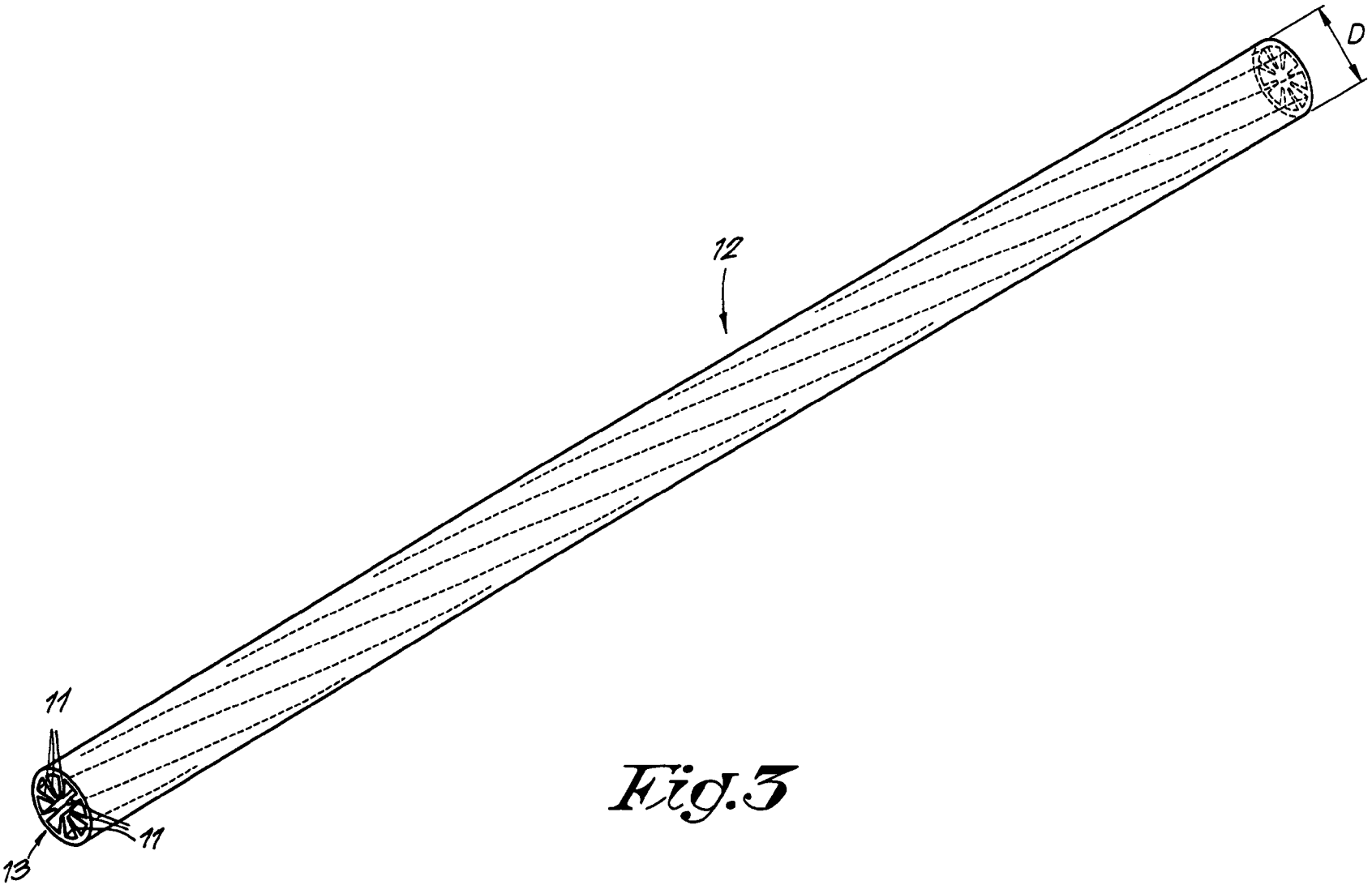
FIG. 3 schematically represents a view in perspective of the part that is indicated by arrow F3 in FIG. 2.
Figure 4:
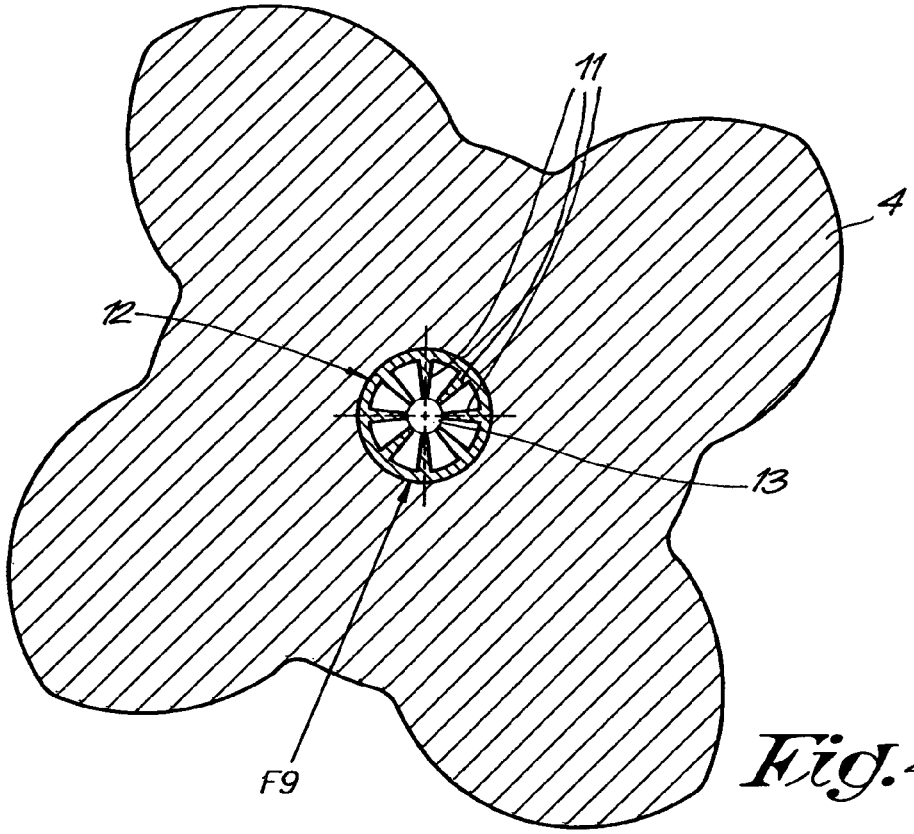
FIG. 4 is a section according to line IV-IV in FIG. 2.

According to the invention, the above-mentioned cooling channel 8 is at least partly provided with inwardly directed fins 11 which preferably have a spiral pattern, as represented in FIG. 3, in the axial direction of the rotor 4 or 5.

In the given example, the above-mentioned fins 11 are part of a tubular element 12 which is provided in the above-mentioned cooling channel 8 and is fixed therein, for example by means of soldering, hydro shaping, casting in, welding or the like.

The outer diameter D of the above-mentioned element 12 amounts to for example 16 millimeters, whereas the wall of the element has a thickness of for example practically one millimeter, but not in a restrictive manner.

Evenly distributed over the perimeter of the element 12 and thus of the cooling channel 8, are provided eight of the above-mentioned inwardly directed fins 11, which in this case extend radially and whose free ends, seen as a cross section, are situated at a distance from one another, so as to form a central, open channel 13.

In this case, the above-mentioned central channel 13 has a diameter of for example 4 millimeters, for a pitch of the fins of 333 millimeters, but the invention is not limited thereto.

The fins 11 are preferably identical to one another but, according to the invention, the fins 11 may also have different dimensions and/or shapes.

According to the invention, the number of fins 11 is not restricted to eight either, but more or less fins 11 can be provided. Preferably, however, the number of fins is as large as possible.

In the given example, every inwardly directed fin 11 has such a spiral twist that it will make almost a complete rotation of 360° over the perimeter of the cooling channel 8 over the length of the fins 11, but it is clear that also several revolutions of the fins 11 can be realised over the same length.

On the inlet side of the cooling channel 8, a first gear 14 is provided at the far end of the shaft 6 of the male rotor 4 that works in conjunction with a driving gear 15 which is schematically represented by means of a dashed line and that is driven by means of a driving motor 16 represented by means of a dashed line.

At the other far end of the shaft 6 of the male rotor 4 is provided a first synchronization gear 17 that works in conjunction with a second synchronisation gear 18 at the far end of the shaft 6 of the female rotor 5 so as to drive it.

In order to axially clamp the above-mentioned bearings 7 and gears 14, 17 and 18 on the shafts 6, bushes 19 are screwed in the above-mentioned cooling channels 8 in the respective far ends of the shafts 6 which extend at least over one length in the cooling channel 8 and which also extend outside the cooling channel 8 with a part 20, whereby a flange 21 is provided on this part 20 which clamps the bearings 7 and gears 14, 17 and 18 on the shaft 6 of the rotor 4 or 5 and provides for a sealing (or a part of it) of the cooling agent. In this case, said sealing is formed of a mechanical sealing, but it is clear that it can also be made in the form of a dynamic, hybrid or any other type of sealing.

According to the invention, it is not strictly necessary for the above-mentioned bush 19 to be fixed in the mounting channel 22 by means of screws, but it is also possible to fix it by means of pressing or the like.

In this case, the above-mentioned bush 19 and the flange 21 are made as one whole, whereby the above-mentioned flange 21 is in this case made as a hexagonal head so as to make it possible for the bush 19 to be screwed in the cooling channel 8 by means of conventional tools.

In the above-mentioned bush 19 is provided a continuous mounting channel 22 which has a widened part 23 near the front end of the bush 19, namely the far end which is screwed in the mounting channel 22.

According to a preferred characteristic of the invention, means 24 are each time provided at the inlet of the cooling channel 8 in the respective shafts 6, which means 24 provide the cooling agent with a tangential component of velocity, when the rotor is turning, which is preferably equal to that of the turning rotor.

Figure 5:
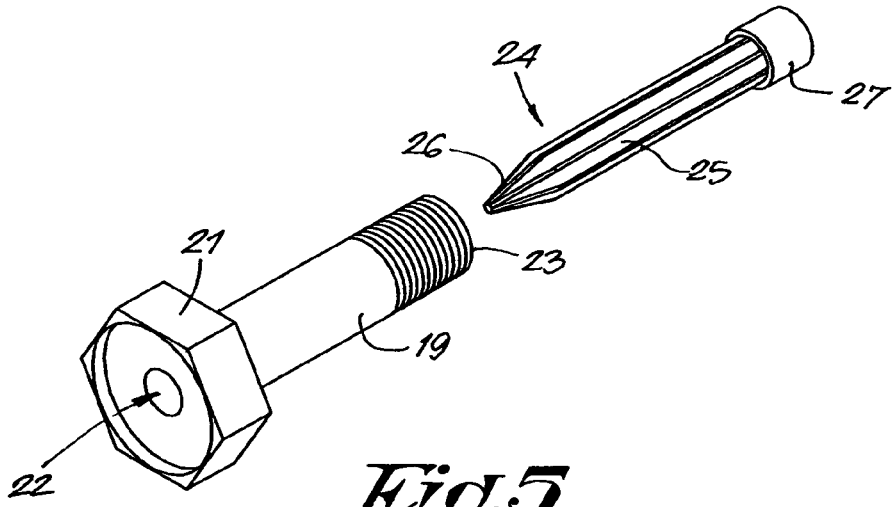
FIG. 5 is a view of the part indicated by F5 in FIG. 2 as disassembled.
Figure 6:
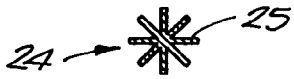
FIGS. 6 and 7 are sections according to lines VI-VI and VII-VII respectively in FIG. 2.
Figure 7:
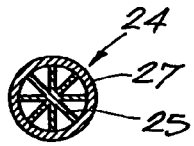

As is represented in greater detail in FIGS. 5 to 7, the above-mentioned means 24 in this case comprise a star-shaped profiled inserting element 25 with a conical, in this case sharp end 26 which, when mounted as represented in FIG. 2, is directed away from the above-mentioned fins 11, or in other words is directed against the flow of the cooling agent.

As is represented in FIG. 7, the above-mentioned inserting element 25 is provided with a case 27 around its other, non-conical far end which fits in the above-mentioned widened part 23 of the mounting channel 22 of the bush 19.

In this case, the inserting element 25 is provided in a fitting manner in the above-mentioned bush 19, as the diameter of this inserting element 25 is equal to the inner diameter of the mounting channel 22 in the bush 19.

However, it is also possible according to the invention for the diameter of the inserting element 25 to be smaller than the diameter of the mounting channel 22.

The above-mentioned means 24 are preferably fixed in the mounting channel 22 of the bush 19, for example by means of radial clamping, by providing an outside thread on the above-mentioned case 27 that can co-operate with an internal screw thread in the above-mentioned widened part 23 of the mounting channel 22, by means of welding, gluing or the like.

Opposite the inlet 9 and the outlet 10 of the cooling channel 8 are in this case further provided an inlet coupling 28, outlet coupling 29 respectively, which make it possible to connect a supply line, discharge line respectively for a cooling agent.

The sealing between the cooling agent and the oil side in the compressor can for example be provided for by means of a mechanical sealing, a dynamic sealing, a hybrid sealing or the like.

Figure 8:
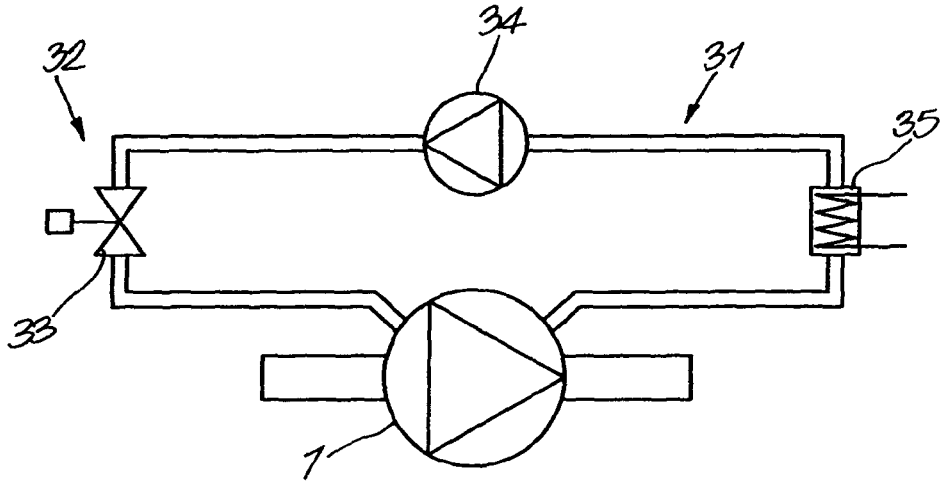
FIG. 8 schematically represents a compressor element with at least one rotor and with a cooling circuit according to the invention.

As is schematically represented in FIG. 8, the compressor element 1 may be provided with a cooling circuit 31 for the cooling agent, whereby adjusting means 32 are preferably provided in this cooling circuit 31 to adjust the flow and/or the temperature of the cooling agent which flows through the cooling channel 8, which means are in this case made in the shape of an either or not automatic control valve 33.

The above-mentioned cooling circuit 31 is in this case made as a closed cooling circuit in which a cooling pump 34 or cooling compressor is provided on the one hand, and a cooler 35 on the other hand that can be any type of cooler whatsoever, such as an air-cooled or fluid-cooled cooler.

The working of a compressor element 1 that is provided with a cooled rotor 4 and/or 5 according to the invention is very simple and as follows.

When the driving motor 16 is started, the male rotor 4 is driven via the co-operating gears 14 and 15.

In the known manner, the synchronisation gears 17 and 18 make sure that also the female rotor 5 is being driven, such that a gas is drawn in and compressed in the compression chamber 3 of the compressor element 1 in the known manner.

It is known that, during the compression, the gas, the rotors 4 and 5, and the housing 2 of the compressor element 1 are heated up considerably.

In order to discharge this compression heat, the cooling circuit 31 is switched on as the pump 34 or the refrigeration compressor is activated and a cooling agent flows via the inlet 9 in the cooling channel 8 in the rotor 4.

According to the invention, the cooling agent may be formed of gaseous or liquid substances, such as air, oil, polyglycol, CFC's, refrigerants and the like.

The incoming cooling agent first flows between the fins of the inserting element 25, whereby, thanks to the conical far end 26 of this inserting element 25, the cooling agent systematically/gradually builds up a tangential velocity in the radial sense.

Figure 9:
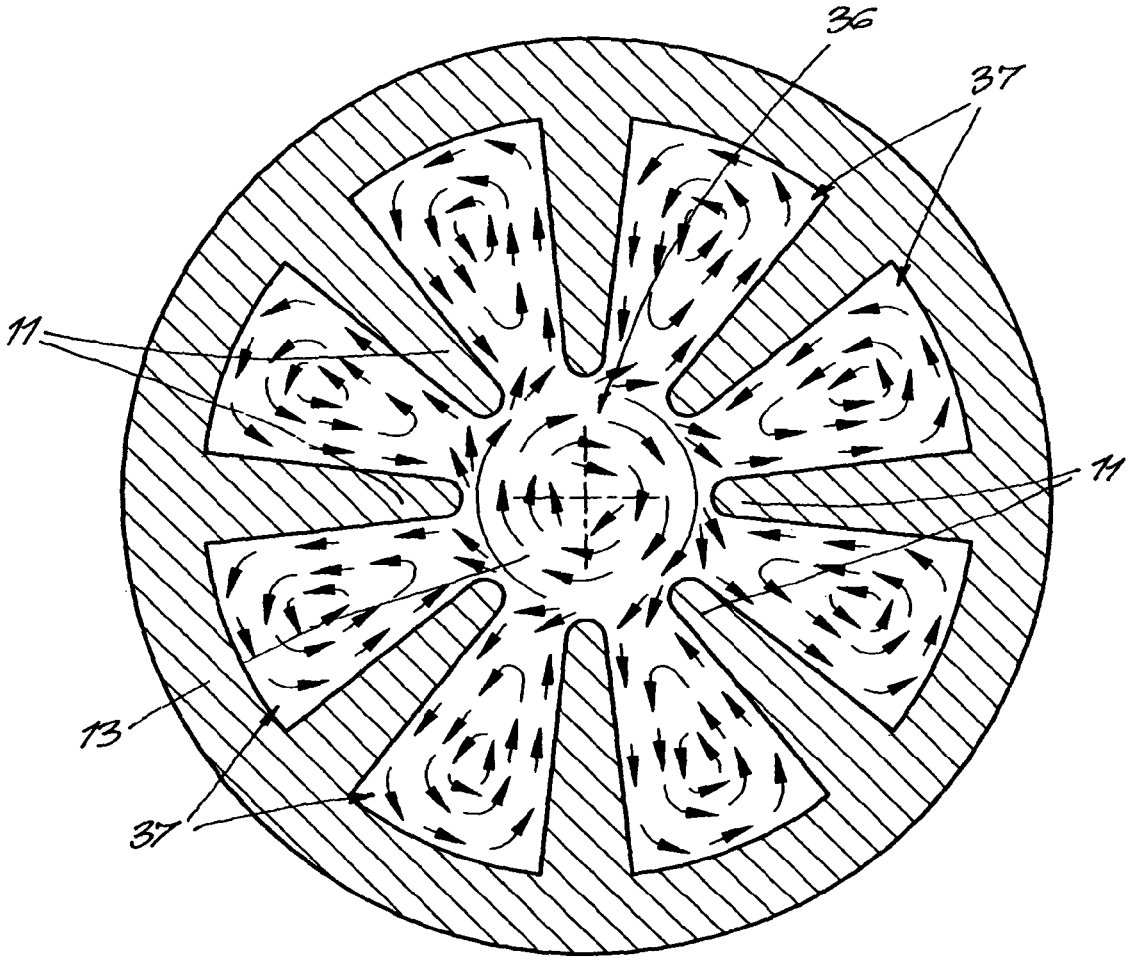
FIG. 9 represents the part indicated by arrow F9 in FIG. 4 to a larger scale.

Thanks to the tangential component of velocity, the cooling agent, after its passage along the inserting element 25, can relatively easily flow along the inwardly directed fins 11 whereby, as represented in FIG. 9, a spiral primary flow 36 will initially occur in the central channel 13, and whereby secondary flows 37 are formed between the respective fins 11 which promote an optimal heat transfer between the cooling agent and the wall of the cooling channel 8, since the surface with which every part of the cooling agent makes contact is larger here than in the case of an axial or spiral flow through the cooling channel.

The spiral course of the inwardly directed fins 11 has a very positive influence on the flow pattern of the cooling agent in the cooling channel 8, such that an even better heat transfer is obtained.

Moreover, the presence of the above-mentioned fins 11 makes sure that the heat-exchanging surface is very large, which also has a positive effect on the heat transfer.

In order to adjust or set the temperature and the viscosity of the cooling agent, use can be made of the above-mentioned adjusting means 32, for example by further opening the control valve in order to make the temperature of the cooling agent drop.

Vice versa, in order to make the temperature of the cooling agent rise, the control valve 33 is closed somewhat further.

In this manner, it is possible to restrict and control the expansion of the rotors 4 and 5 under the influence of the compression heat, such that any wear of the rotors 4 and 5 caused by mutual contact in case of too much expansion is restricted.

Vice versa, in case of a lower thermal load, it is possible to reduce the rotor play by heating the rotors 4 and 5 and thus increase the efficiency.

According to the invention, the abovementioned fins 11 must not necessarily be part of a separate element 12, but it is also possible for these fins 11 to form an integral part of the rotor 4 or 5.

Nor is it necessary for the fins 11 to be radially directed; also bent fins and/or fins that are inserted slantingly in relation to the radial direction can be applied.

In the given example, the diameter of the above-mentioned inserting element is smaller than the diameter of the cooling channel 8. However, according to an embodiment which is not represented in the figures, it is also possible for the diameter of the inserting element 25 to be equal to the diameter of the cooling channel 8 and for the inserting element 25 to be fixed directly in this cooling channel 8, without any bush 19 being used thereby.

In the given example, the rotors 4 and 5 according to the invention are applied in a compressor element 1, but it is not excluded according to the invention to apply a rotor according to the invention in other types of devices requiring some heat dissipation, such as generators, motors and the like.

In the given example of the compressor element 1, the respective rotors 4 and 5 are made such that the inlet 9 of the cooling channel 8, which is provided in each of the respective shafts 6, is situated on the driving side of the compressor element 1, in other words on the side where the driving motor 16 is situated.

It is clear that the rotors 4 and 5 can also be made such that the respective inlets 9 of their cooling channels 8 are situated on different sides of the compressor element 1.

It is also possible to provide a separate cooling circuit 31 for each rotor 4 and 5 or to connect them to a single cooling circuit 31, whereby the cooling agent can flow in series or in a parallel manner through the respective cooling channels 8.

It is clear that, instead of a separate cooling circuit, use can also be made of a conventional, available cooling circuit which makes use for example of the oil or of the water that is applied for the lubrication and cooling, or of oil-lubricated and water-injected compressors respectively.

Finally, it is possible according to the invention to make the cooling agent flow counterflow through the respective rotors 4 and 5 or in a single direction.

According to the invention, the cooling agent can be made to flow counterflow to the compressed air path, but it can also be made to flow in the same flow direction as the compressed air.

Also, the direction of flow, the flow rate and the temperature of the cooling agent in the cooling channels of the respective rotors can be selected independently from one another, such that an independent expansion control of both rotors can be obtained.

The present invention is not restricted to the application in a screw compressor, but it can also be applied in other types of compressors, such as for example tooth compressors, roots blowers, turbo compressors scroll compressors and the like.

Moreover, the invention is not restricted to compressors, but it can also be used in all sorts of applications with rotors that need to be provided with a cooling, such as in the case of generators, motors, cutting tools and the like.

The present invention is by no means restricted to the embodiments described as an example and represented in the accompanying drawings; on the contrary, such a rotor 4, 5 according to the invention and a compressor element 1 that is provided with such a rotor 4, 5 can be made in all sorts of shapes and dimensions will still remaining within the scope of the invention.

The invention claimed is:

1. Rotor comprising:

a shaft having an axial direction, a center extending in the axial direction, and first and second ends, wherein the first and second ends are arranged to be attachable to provide rotation of the shaft;

an inner and central cooling channel arranged in the center of the shaft to extend in the axial direction of said shaft, wherein said inner and central cooling channel includes an inlet and an outlet at the first and second ends of the shaft configured to receive a cooling agent and arranged for circulating said cooling agent in the center of the shaft; and a tangential element positioned near the inlet of the inner and central cooling channel to provide a tangential component of velocity to the cooling agent when said cooling agent is received in the cooling channel;

wherein the cooling channel includes inwardly directed fins, and wherein the tangential element comprises a star-shaped, profiled insert element having a conical end, wherein the conical end is directed away from the fins and arranged against a flow of said cooling agent when said cooling agent is received in the cooling channel.

2. Rotor according to claim 1, wherein the fins have a spiral pattern in the axial direction of the rotor.

3. Rotor according to claim 1, wherein said fins are part of an element that is provided in the cooling channel.

4. Rotor according to claim 3, wherein the element is secured in the cooling channel of the rotor by soldering, hydro-shaping, casting in, or welding.

5. Rotor according to claim 1, wherein the fins form an integral part of the rotor.

6. Rotor according to claim 1, wherein the inwardly directed fins are radially directed.

7. Rotor according to claim 1, wherein free ends of the fins are located at a distance from one another so as to form a central, open channel.

8. Rotor according to claim 1, wherein the fins are evenly distributed over the perimeter of the cooling channel.

9. Rotor according to claim 1, wherein the fins are identical.

10. Rotor according to claim 1, wherein the insert element includes a bush extending at least over a length in the inlet of the cooling channel in the rotor.

11. Rotor according to claim 10, wherein the insert element is disposed in the bush in a fitting manner.

12. Rotor according to claim 10, wherein the bush is fixed in the cooling channel by means of screws.

13. Rotor according to claim 10, wherein the bush extends with one part outside the cooling channel, and a flange is provided on said part for enabling clamping of a gear, a bearing, or combinations thereof on the shaft.

14. Rotor according to claim 1, wherein the tangential element for providing a tangential component of velocity and the inwardly directed fins are located at a distance from one another.

15. Rotor according to claim 1, wherein the insert element of the tangential element has a diameter smaller than a diameter of the cooling channel.

16. Rotor according to claim 1, wherein the tangential element for providing a tangential component of velocity is configured such that the cooling agent is provided with a tangential component of velocity which is equal to that of the rotor when the rotor is turning.

17. Rotor according to claim 1, configured as a male or female rotor of a screw compressor element.

18. Compressor element having a housing with a compression chamber, wherein the compression chamber comprises at least one rotatable rotor according to claim 1.

19. Compressor element according to claim 18, including a cooling circuit for cooling the cooling agent circulated through the rotor.

20. Compressor element according to claim 19, wherein the cooling circuit is provided with adjustment devices for adjusting the flow of the cooling agent flowing through the cooling channel.

21. Compressor element according to claim 18, configured in a shape of a screw compressor element.

22. Compressor element according to claim 18, wherein, between the cooling agent and an oil side in the compressor there is provided a seal arrangement.

* * * * *